US006796249B1

(12) United States Patent
Hiras

(10) Patent No.: US 6,796,249 B1
(45) Date of Patent: Sep. 28, 2004

(54) WINDOW SHELF

(76) Inventor: Minas N. Hiras, 16 Powderhorn Rd., Flemington, NJ (US) 08822

( * ) Notice: Subject to any disclaimer, the term of this patent is extended or adjusted under 35 U.S.C. 154(b) by 127 days.

(21) Appl. No.: 09/706,429

(22) Filed: Nov. 4, 2000

(51) Int. Cl.[7] ..... A47B 23/04

(52) U.S. Cl. ..... 108/157.13; 220/480; 248/235; 211/88.01

(58) Field of Search ..... 108/27, 33, 43, 108/42, 92, 180, 152, 159.11, 157.13, 157.15, 157.16, 157.18, 158.13; 248/235, 250, 236, 231.41, 228.3, 300; 211/88.01, 88.03, 80.01, 139; 220/480

(56) References Cited

U.S. PATENT DOCUMENTS

| | | | | |
|---|---|---|---|---|
| 883,001 A | | 3/1908 | Curtis | |
| 1,283,029 A | | 10/1918 | Arntz | |
| 1,914,617 A | | 6/1933 | Rogers | |
| 2,051,241 A | | 8/1936 | Biggers | |
| 2,544,203 A | | 3/1951 | Watkins | |
| 4,575,149 A | * | 3/1986 | Forestal et al. | 248/231.4 X |
| 4,653,712 A | | 3/1987 | Murray et al. | |
| 5,020,756 A | * | 6/1991 | Bauer | 248/235 X |
| 5,368,267 A | * | 11/1994 | Howard | 248/231.41 X |
| 5,402,976 A | * | 4/1995 | Pollack | 248/300 |
| 6,016,628 A | * | 1/2000 | Schlosser | 47/65.8 |
| 6,237,799 B1 | * | 5/2001 | Emerson | 220/480 |

* cited by examiner

*Primary Examiner*—John G. Weiss
*Assistant Examiner*—Michael J. Fisher
(74) *Attorney, Agent, or Firm*—Patricia A. Wenger

(57) ABSTRACT

A shelf that can be hung on a window structure. The shelf has a projecting member and a horizontal member that envelop the top of the window structure. The horizontal member can be moveable to clamp the window structure between the horizontal member and the projecting member. The shelf can include a cover to provide an ideal growing environment for plants, especially Bonsai plants. Accessories, such as picture frames, can be attached to the shelf. The shelf can include more than one tray.

41 Claims, 8 Drawing Sheets

WINDOW SHELF

BACKGROUND OF THE INVENTION

Many shelves that can be hung from windows, such as the shelf disclosed in U.S. Pat. No. 2,544,203 to Watkins, are not capable of securely attaching to the window and have the potential of being easily dislodged.

Conversely, other window shelves are held in place by means of nails and screws that attach portions of the shelf directly to the window frame. These shelves may be sturdy, however, they are difficult to install, damaging to the window structure and difficult to remove from the window.

Other shelves are known in the art that hang from the window structure without the requirement of nailing or screwing the shelf into the window frames. One such shelf is described in U.S. Pat. No. 5,020,756 to Bauer. However, this shelf utilizes a bracket that attaches to the interior casings of the window. This shelf is limiting, among other reasons, because it requires the window structure to have interior casings, and it has the potential of damaging the interior casings, thereby restricting the functionality of the window structure to house and guide the window.

SUMMARY OF THE INVENTION

The current invention discloses a shelf that is hung on a window in a secure manner, and that is not damaging to the window structure. Specifically, the invention discloses a shelf that can be hung on a window structure, whereby the shelf includes a primary tray that has a projecting member that is insertable behind the back of the window structure. The primary tray has a top side and a bottom side and the shelf further includes a horizontal member, which is located on the bottom side of said primary tray, and which is engagable with the front of the window structure. In a preferred embodiment, the horizontal member is moveable.

The horizontal member can further include a perpendicular piece, which has at least one opening. In this embodiment the shelf further includes at least one set device, which projects through the at least one opening in the perpendicular piece to engage the bottom said of said primary tray. The device affixes the horizontal piece to said primary tray and affixes the horizontal piece against said window structure. In this embodiment the bottom side of the primary tray can further include at least one threaded receptacle, wherein the at least one set device can be threaded. Also, the at least one set device can have a head that is wider than the width of the opening on said perpendicular piece, whereby the threaded set device can be threaded into the at least one threaded receptacle until the head engages the at least one opening. In addition, the at least one opening can be elongated.

The shelf of the current invention can include an upper rim on the top side of the primary tray.

In another embodiment of the invention, the horizontal piece can further include a plurality of brackets, which engage the upper rim on opposite sides of said primary tray. In this embodiment, each of the brackets further includes at least one set device, which engages the upper rim, and thereby affixing the lateral movement of the horizontal member against the window structure.

The primary tray can have a window edge that has at least one window lock indentation.

The top side and bottom side of the primary tray can further include reinforces.

The shelf of the invention can further include a cover. In one embodiment, the cover can have a dome-shaped top, and least one ventilation hole. The shelf can further include gravel, which can be placed on the top side of said primary tray, and on top of which at least one Bonsai plant can be placed.

The primary tray can also hold at least one plant. Also, the primary tray of the shelf can further hold growing medium, in which at least one plant can be located.

The shelf can also include an accessory. The accessory can be attached to a bracket, which is attachable to the upper rim of the primary tray. The accessory can be a picture frame.

The shelf can also have a second tray, which is attached to the primary tray by an attachment means. The second tray can attach to the primary tray by at least two attachment pieces. Each of the at least two attachment pieces can have a top end and a bottom end. The top end of each of the attachment pieces can have a hooking means, which hook over opposite upper rims on the primary tray. The second tray can further have a bottom rim, which projects downward from the edges of the second tray. The bottom end of each of the attachment pieces can have a hooking means, which hook under opposite bottom rims on the second tray.

The shelf can further have a bottom rim, which projects downward from the edges of the primary tray. The bottom rim can have a height that is no greater than the height of the projecting member, with the height of the bottom rim of the front edge of the primary tray being equal to the height of the projecting member, whereby when the primary tray is taken off the window structure and is placed on a horizontal surface, the primary tray is flat.

The shelf can also include a primary tray to which a projecting member is attached.

BRIEF DESCRIPTION OF THE DRAWINGS

The accompanying drawings, which are incorporated in and form a part of the specification, illustrate the embodiments of the present invention and, together with the description serve to explain the principles of the invention.

DETAILED DESCRIPTION OF THE PREFERRED EMBODIMENTS

Figure 1:
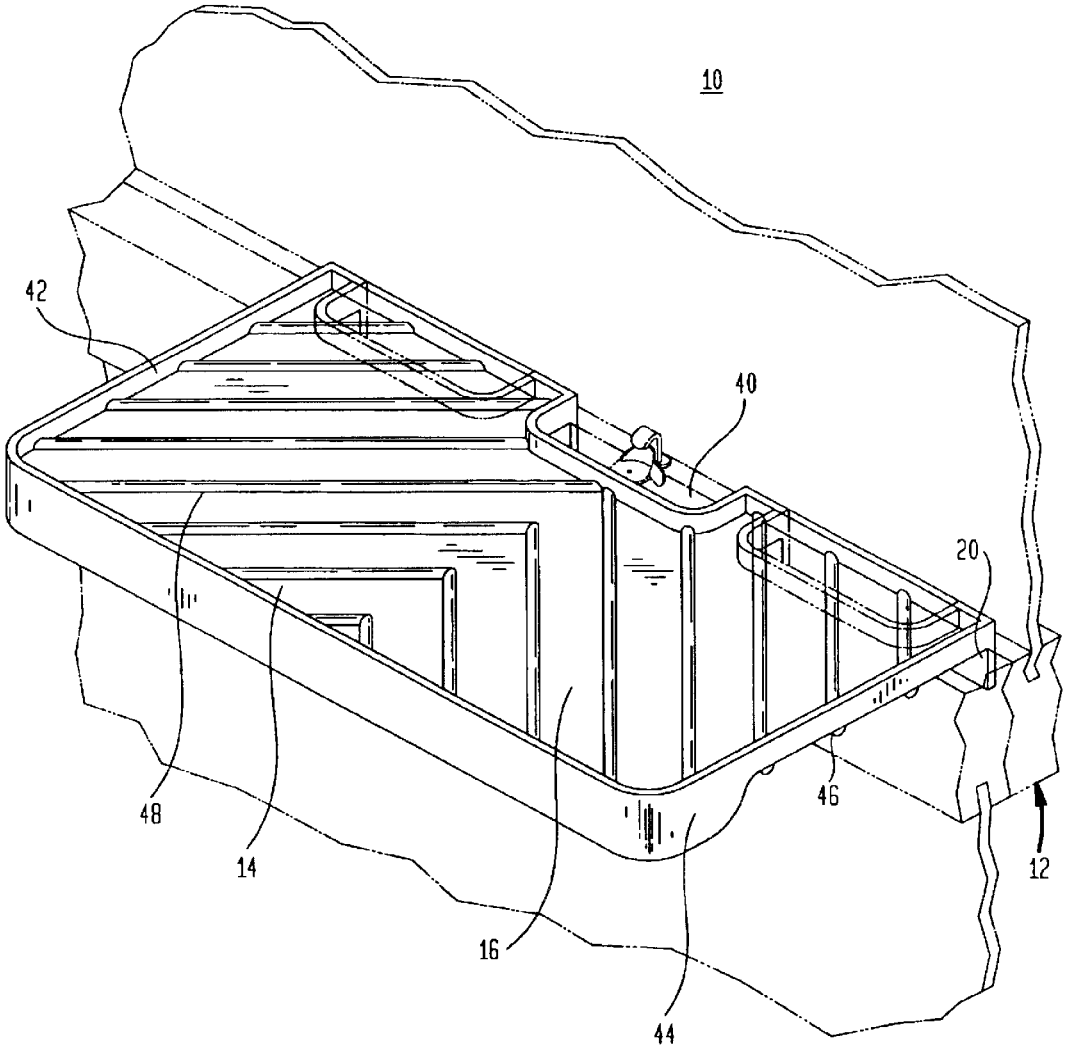
FIG. 1 is a perspective view of a preferred embodiment of the shelf of the current invention.

In describing the preferred embodiments of the invention illustrated in the drawings, specific terminology will be used for the sake of clarity. However, the invention is not intended to be limited to the specific terms so selected, and it is to be understood that each specific term includes all technical equivalents which operate in a similar manner to accomplish a similar purpose.

Figure 2:
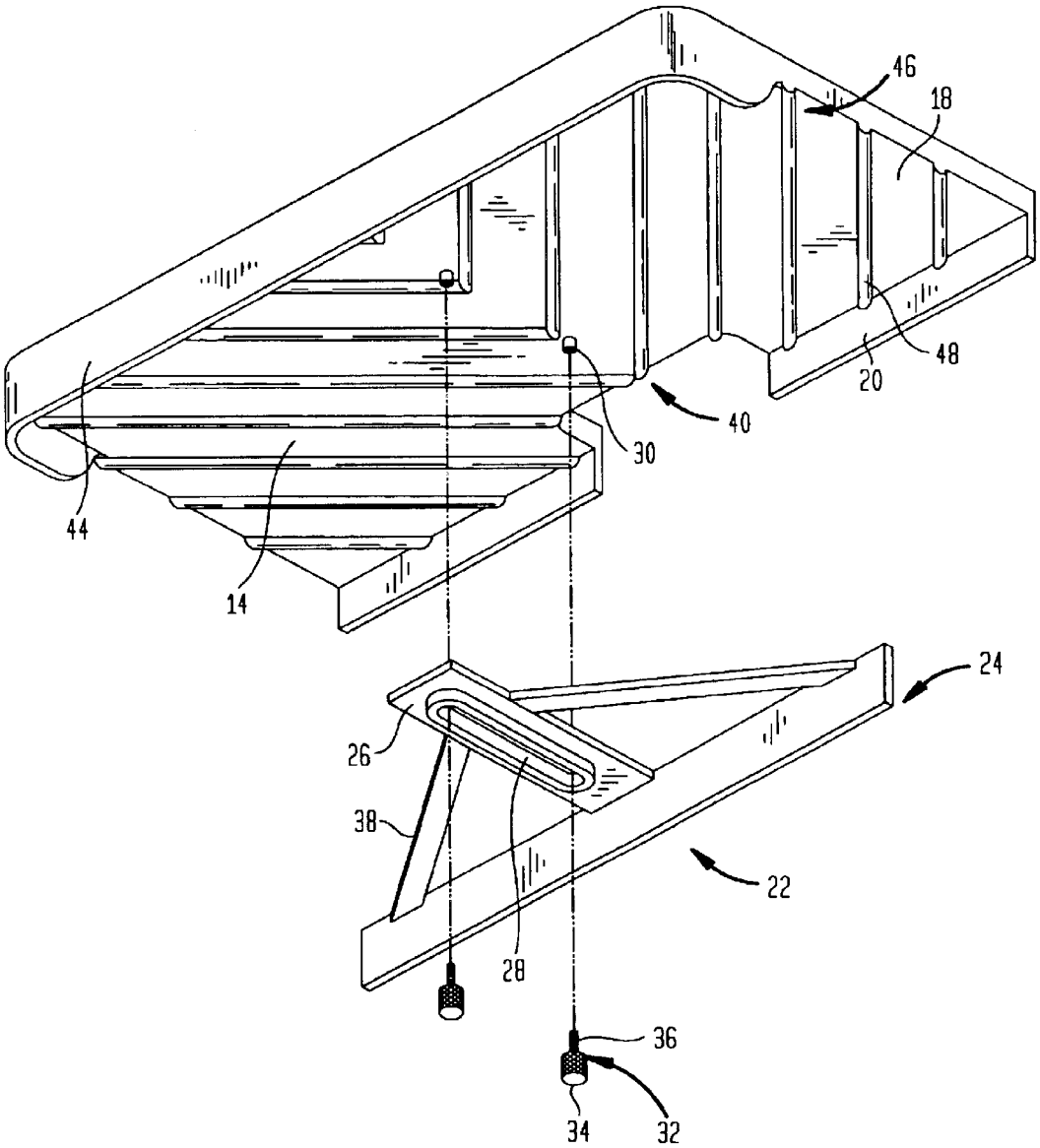
FIG. 2 is an exploded bottom perspective view of the shelf.
Figure 3:
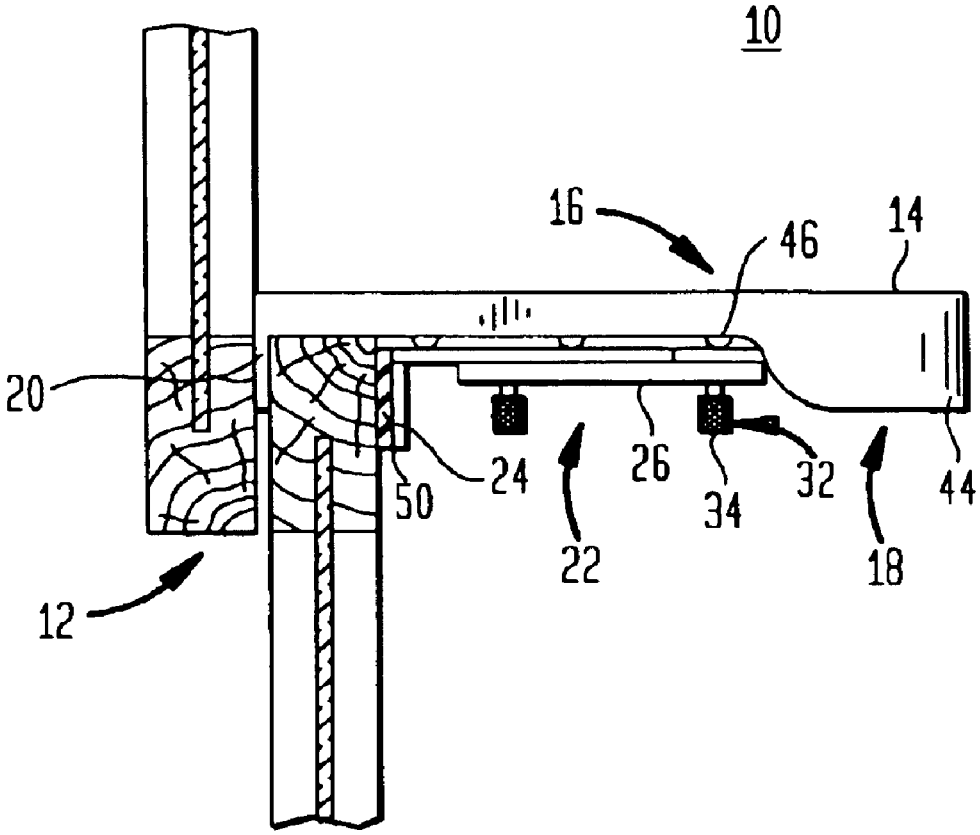
FIG. 3 is a cross-sectional view of the shelf assembled on a window structure.

Reference is now made to FIGS. 1, 2 and 3, wherein a preferred embodiment of the window shelf 10 of the invention is illustrated. The shelf 10, which can easily be hung and/or removed from a window structure 12, includes a primary tray 14, which has a top side 16 and a bottom side 18. Items can be placed on the top side 16 of the primary tray 14.

The primary tray 14 also has a projecting member 20. To hang the shelf 10 on the window structure 12, a downwardly projecting member 20 is inserted behind the window structure 12. In this embodiment, a double-hung window is illustrated, and the projecting member 20 is inserted behind the top window frame of the bottom window of the double hung windows.

The shelf 10 further includes a horizontal member 22, which is located on the bottom side 18 of the primary tray 14. The engaging edge 24 of the horizontal member 22 engages the front of the window structure 12 to hold the primary tray 14 onto the window structure 12. Generally, the horizontal member 22 engages the front of the window structure 12 at a location that is opposite the location where the projecting member 20 engages the back of the window. It is to be understood that the shelf 10 can be hung on the window structure 12 in this manner when the window is closed, or when the window is opened. In addition, while the shelf 10 is hanging on the window, the window can be raised or lowered the entire range between being totally closed and totally opened.

In this preferred embodiment, the horizontal member 22 is moveable. As a result, the horizontal member 22 can be pushed forward to clamp the window structure 12 and form a snug fit against the front of the window structure 12; and thereby increase the stability of the shelf 10 on the window. As best seen in FIG. 2, the horizontal member 22 in this embodiment includes a perpendicular piece 26, which has at least one opening 28. In this embodiment, one opening 28 is included, which is elongated. The bottom side 18 of the primary tray 14 further includes at least one set device receptacle 30. Two threaded receptacles 30 are shown in this embodiment. In addition, in this embodiment, at least one set device 32 is used to affix the horizontal member 22 to the bottom side 18 of the primary tray 14 and to the front of the window structure 12. Numerous types of set devices 32, such as screws, bolts, tacks, clamps and the like, are known in the art and could be used in this invention.

In this embodiment, the set devices 32 are two threaded screws, which are threaded through the elongated opening 28 and threaded into the threaded receptacles 30. The screws in this embodiment each have a head 34 that is wider than the width of the elongated opening 28. When the screws are threaded into the threaded receptacles 30, the head 34 of the screws press against the elongated opening 28, thereby affixing the horizontal member 22 to the bottom side 18 of the primary tray 14. In this embodiment, the threaded portion 36 of the screws must be shorter in length than the threaded receptacle 30, thereby, when the head 34 of the screw engages the opening 28, it can push the perpendicular piece 26 snugly against the bottom side 18 of the primary tray 14. As a result, the horizontal member 22 will be set in place, both vertically against the bottom side 18 of the primary tray 14, and horizontally against the front of the window structure 12.

As best seen in FIG. 3, the engaging edge 24 of the horizontal member 22 can engage the front of the window structure 12. By pressing the engaging edge 24 of the horizontal member 22 against the front of the window structure 12, and affixing the horizontal member 22 in place, the window structure 12 will be wedged between the projecting member 20 and the horizontal member 22. The shelf 10 is firmly held to the window structure 12 in this manner. In this embodiment, the preferred height of the engaging edge 24 of the horizontal member 22 is approximately ½ inch. Support pieces 38 between the perpendicular piece 26 and the horizontal portion of the horizontal member 22 can be added for strength and/or stability.

In this embodiment, the horizontal member 22 may be slid toward or away from the front of the window structure 12 a distance that is approximately the length of the elongated opening 28. When the horizontal member 22 is located in its desired location, it may be affixed by threading at least one of the screws into the threaded receptacle 30, which also affixes the horizontal member 22 to the bottom side 18 of the primary tray 14.

Accordingly, the window shelf 10 is easily hung on the window by inserting the projecting member 20 behind the top of the window. The horizontal member 22 is pushed forward until the engaging edge 24 engages the front of the window structure 12. Thereafter at least one of the screws is threaded through the opening 28 and into the threaded receptacle 30 until the head 34 of the screw engages the opening 28. As a result, the horizontal member 22 is held in place against the window structure 12 and the against the bottom side 18 of the primary tray 14. Conversely, the shelf 10 is easily removed from the window by unthreading the screw until is clear of the threaded receptacle 30. Thereafter, the horizontal member 22 can be separated from the primary tray 14, and the primary tray 14 can be lifted upward until the projecting member 20 no longer is positioned behind the top of the window structure 12.

It is also possible to keep the horizontal member 22 attached to the primary tray 14 by partially threading at least one screw into the threaded receptacle 30 so that the head 34 of at least one screw loosely holds the horizontal member 22 to the primary tray 14 white allowing the horizontal member 22 to slide toward and away from the window structure 12. Optionally, the bottom side 18 of the primary tray 14 can have a pair of tracks (not shown), which would hold the horizontal member 22 to the bottom side 18 of the primary tray 14 while allowing the horizontal member 22 to slide toward and away from the window structure 12. Accordingly, the window shelf 10 can be easily hung on the window by inserting a top portion of the window structure 12 between the projecting member 20 and the horizontal member 22. The horizontal member 22 is pushed forward until it engages the front of the window structure 12. Thereafter at least one of the screws is threaded through the opening 28 and into the threaded receptacle 30 until the head 34 of the screw engages the opening 28. As a result, the horizontal member 22 is held snugly in place against the window structure 12 and the against the bottom side 18 of the primary tray 14. Conversely, the shelf 10 can be easily removed from the window by unthreading all the screws holding the horizontal member 22 to the bottom side 18 of the primary tray 14 until there is space between the bottom side 18 of the primary tray 14 and the horizontal member 22. Thereafter, the horizontal member 22 can be slid away from the front of the window structure 12, and the primary tray 14 can be lifted upward until the top of the window structure 12 no longer is positioned between the projecting member 20 and the horizontal member 22.

In the preferred embodiment illustrated in FIGS. 1–3, the primary tray 14 is in a rectangular shape. In this preferred embodiment, the preferred dimensions of portions of the shelf 10 approximately are the following: the tray is 12½ inches long by 9¾ inches deep; the projecting member 20 is ½ inch long vertically from top to bottom; the engaging edge 24 of the horizontal member 22 is ten inches long; the perpendicular piece 26 is six inches long; and the two set device receptacles 30 are four inches from one another.

Figure 4A:
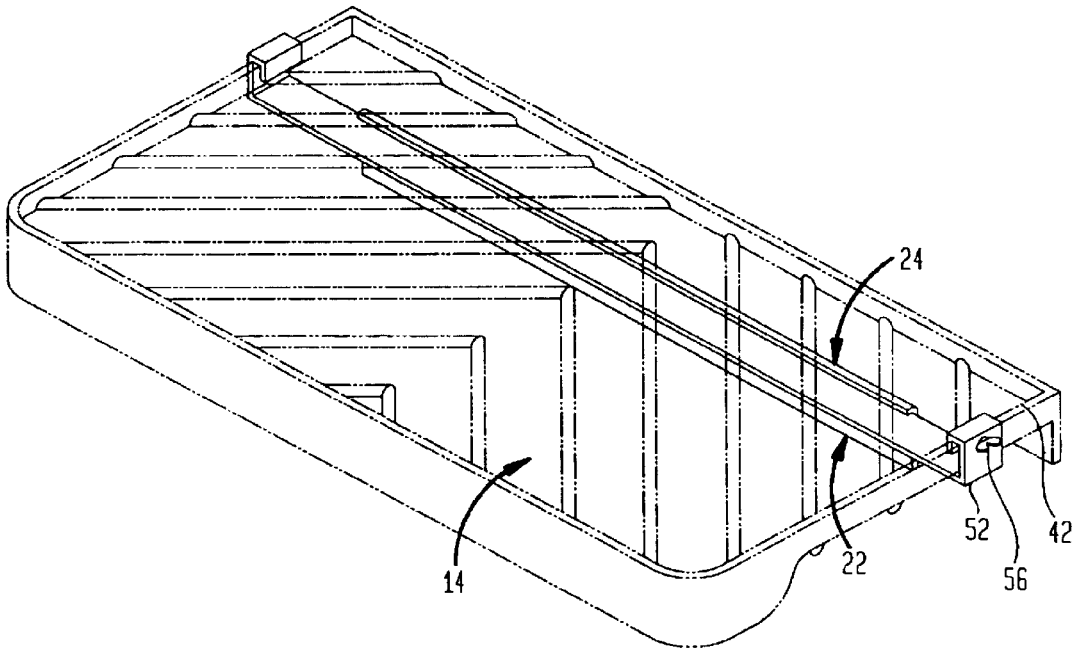
FIG. 4A is a perspective view of another preferred embodiment of the shelf.

However, it is to be understood that the primary tray 14 can be in any shape onto which a projecting member 20 can be attached. In this embodiment, the window edge of the primary tray 14 has a window lock indentation 40. Many widows have window locks at the center of the window structure 12, and this preferred embodiment has a window lock indentation 40 in the center of the primary tray 14. However, the window lock indentation 40 can be placed at any point along the window edge of the primary tray 14 that corresponds to the location of the window lock in the window structure 12. More than one window lock indentation 40 can be included. The projecting member 20 is not included at the location of the window lock indentation 40. In the preferred embodiments each window lock indentation 40 is approximately 3¾ inches wide and 2¼ inches deep. Additionally, as seen in FIG. 4A, the window lock indentation 40 can be omitted for primary trays 14 to be placed on window structures 12 lacking window locks, or for primary trays 14 that may be placed on portions of window structures 12 that do not have window locks. In all of these embodiments, the windows can be locked and/or unlocked while the shelf 10 is attached to the window.

Preferably, all of the edges of the primary tray 14 have an upper rim 42. Preferably, the upper rim 42 is in the range of ¾ of an inch to 2½ inches deep vertically from top to bottom. However, the upper rim 42 can be on fewer than all the edges, and may be totally omitted. The upper rim 42 can be used for keeping items or liquids placed on the primary tray 14 from falling off. Also, as will be described in more detail in reference to FIGS. 4A, 4B, and 5 through 7, the upper rim 42 can provide additional structural benefits.

Preferably, all of the edges other than the window edge of the primary tray 14 have a lower rim 44. However, the lower rim 44 can be on fewer than all the edges, and may be totally omitted. Preferably, the front lower rim 44, the lower rim 44 opposite the projecting member 20, will be approximately ½ inch long vertically from top to bottom, the same height as the projecting member 20; while at the same time, none of the side lower rims 44 have a height that is greater than the height of the projecting member 20. As a result, when the primary tray 14 is taken away from the window and placed on a flat surface the primary tray 14 will be flat. Alternatively, the lower rims 44 on the sides of the primary tray 14 could be of equal height, and of greater height than the projecting member 20 and the front edge lower rim 44. In this manner the primary tray 14 also would lay flat when taken from the window and placed on a flat surface.

As seen in the preferred embodiment, the lower rims 44 on the side of the primary tray 14 are cut away so that only a portion of the sides of the primary tray 14 have a lower rim 44. The cut away 46 area provides a place where a person carrying the primary tray 14 to or from the flat surface may easily place his or her hands. It is to be understood, however, that the cut away 46 areas are optional.

Also in this preferred embodiment, the top side 16 and bottom side 18 of the primary tray 14 have reinforcers 48. The reinforcers 48 in this embodiment are ridges of the material used to make the primary tray 14. However, the primary tray 14 can be reinforced by any material that may be added to the primary tray 14 that will add strength and/or stability. Also, it is to be understood that the reinforcers 48 can be added only to the top side 16 or the bottom side 18 of the primary tray 14, or may be totally omitted.

The shelf 10 can be made of a variety of materials. In the preferred embodiment, the shelf 10 is made of opaque plastic, with the exception of the threads in the set device receptacles 30 and the threaded set devices 32, which are made of metal. However, the shelf 10 also could be made of other materials, such as but not limited to, wood, metal, aluminum, stainless steel, straw, clear plastic or combinations of the materials.

Optionally, the engaging edge 24 of the horizontal member 22 can have a gripping piece 50 that will make a more snug fit of the window structure 12 between the projecting member 20 and the horizontal member 22. The gripping piece 50 preferably is made of any pliable material, such as rubber, clay, and the like, that will mold to any spaces between the engaging edge 24 and the window structure 12.

It is also to be understood that the window shelf 10 also can be held to the window structure 12 by placing the window shelf 10 between the projecting member 20 and the horizontal member 22 in a manner whereby the engaging edge 24 of the horizontal member 22 is not pressed in a flush manner against the window structure 12. Rather, the general enveloping of the window structure 12 by the projecting member 20 and the horizontal member 22 holds the shelf 10 on the window. In this embodiment, greater stability is achieved by increasing the length of the projecting member 20 and the engaging edge 24 of the horizontal member 22. In addition, in this embodiment, the horizontal member 22 can be fixed, rather than moveable. In this embodiment, the window shelf 10 is easily hung on the window by inserting the top of the window structure 12 between the horizontal member 22 and the projecting member 20. Conversely, the shelf 10 is easily removed from the window by lifting the shelf 10 upward until the top of the window structure 12 no longer is positioned between the horizontal member 22 and the projecting member 20.

Figure 4B:
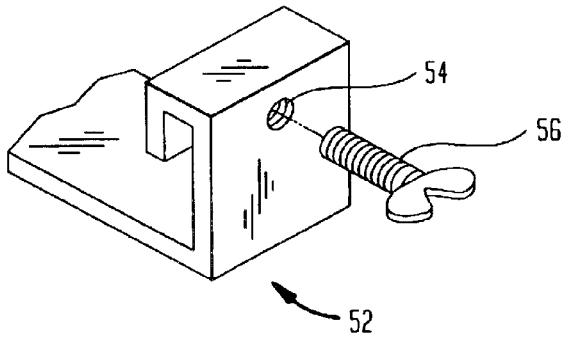
FIG. 4B is a partial perspective view of the bracket used in the view illustrated in FIG. 4A.

Referring now to FIGS. 4A and 4B, another embodiment of the horizontal member 22 is illustrated. In this embodiment, the horizontal member 22 is affixed to the primary tray 14 by at least one bracket 52 at the upper rim 42. In this embodiment, two brackets 52 engage opposite side upper rims 42. The brackets 52 can each have an opening 54 through which a set device 56 can be passed to affix the brackets 52 to the upper rim 42. In this embodiment, the set devices 56 are threaded screws. It is to be understood that any device known in the art that will set the brackets 52 in place along the upper rims 42 can be used. To place the shelf 10 on the window, the projecting member 20 is inserted behind the front of the window structure 12, the horizontal member 22 is slid toward the front of the window structure 12, and affixed at the desired location by tightening the screws against the upper rim 42. To remove the shelf 10 from the window, the screws are loosened, and the horizontal member 22 is slid away from the window. Thereafter, the shelf 10 is lifted from the window structure 12. In this embodiment, the perpendicular piece 26 is not included on the horizontal member 22.

Figure 5:
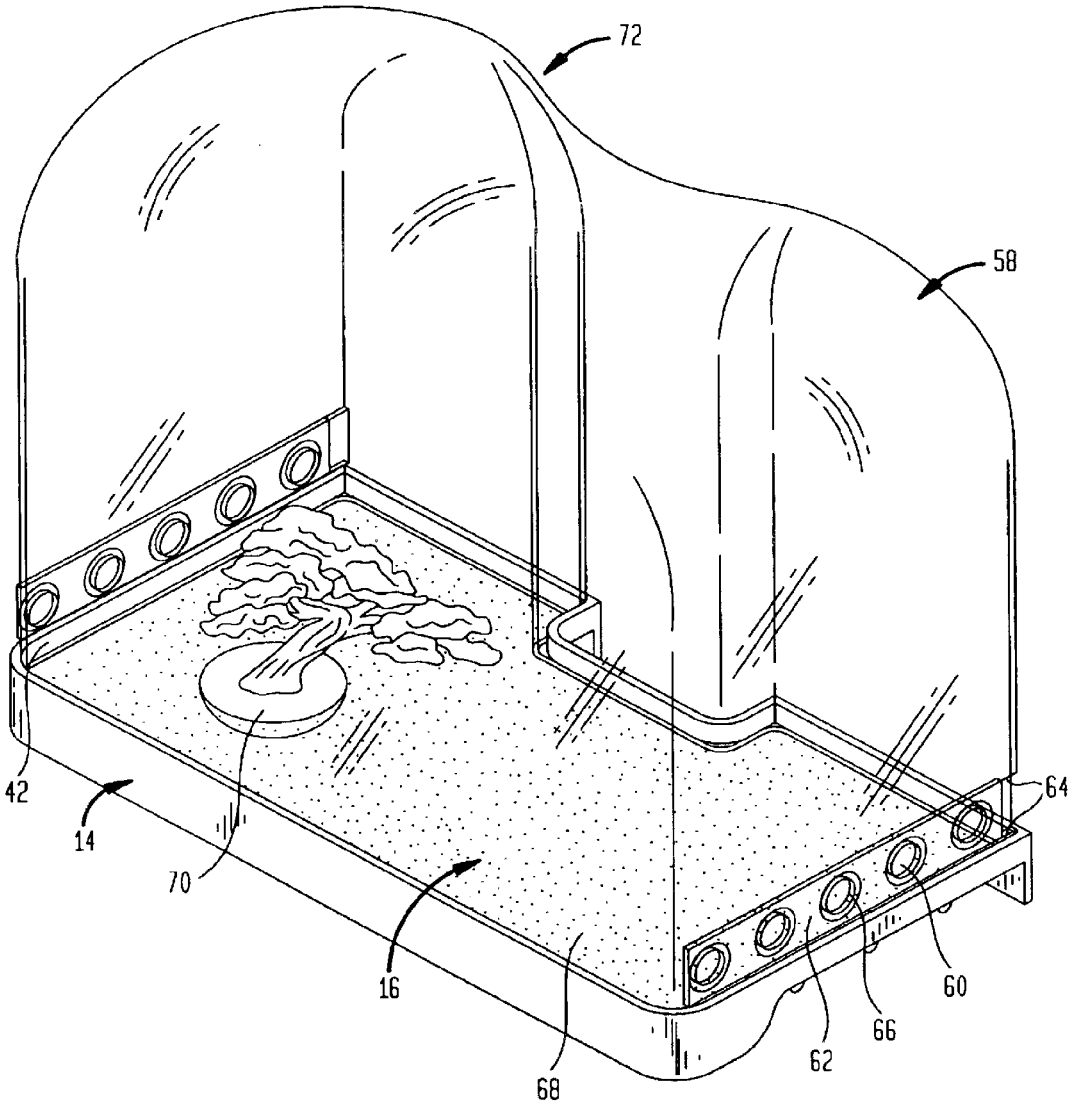
FIG. 5 is a perspective view of the shelf including a cover.

Reference is now made to FIG. 5, in which a cover 58 is placed on top of the primary tray 14. In this preferred embodiment, the cover 58 is made of a clear Plexiglas material, is dome-shaped 72, and has at least one ventilation hole 60. In this preferred embodiment, the cover 58 is approximately 12¾ inches high. Preferably, the cover 58 has the same shape as the primary tray 14, although slightly smaller. As a result, the cover 58 can be placed directly on the top side 16 of the primary tray 14 inside the upper rims 42. In this embodiment, the ventilation holes 60 can be opened or closed by a sliding plastic strip 62 in a set of grooves 64. The plastic strip 62 has holes 66 that correspond the ventilation holes 60 of the cover 58. When the holes 66 and ventilation holes 60 are aligned, ventilation is provided in the covered shelf 10. When the holes 66 and ventilation holes 60 are not aligned, ventilation is not provided in the covered shelf 10. It is to be understood that other means to open and close the ventilation holes 60 could be used, which are known in the art. When the ventilation holes 60 of the cover 58 are closed, the cover 58 creates an enclosed interior environment. In addition, the upper rims 42, inside of which the cover 58 is placed, keep the cover 58 from sliding off the primary tray 14.

In other embodiments of the invention the cover 58 could be made of other materials such as glass, and could be opaque, semi-opaque or partially opaque. In addition, the top of the cover 58 could be another shape, such as flat or pointed, and the ventilation holes 60 could be omitted.

Also seen in this preferred embodiment is the use of the primary tray 14 to hold gravel 68 and a growing Bonsai plant 70. This preferred embodiment illustrates the use of the primary tray 14 to provide an optimal growing environment for Bonsai plants 70. The clear cover 58 enables light, such as sun light, to pass through the cover 58, and to create a tropical terrarium environment in the covered primary tray 14. The dome-shaped top 72 of the cover 58 enables condensation to fall back onto the primary tray 14 and the growing Bonsai plant 70 to create moisture in the interior environment, and moisten needles on the Bonsai plant 70. The gravel 68 which covers the top side 16 of the primary tray 14 allows the moisture to be collected on the bottom of the primary tray 14 thereby creating a humid growing environment in the interior covered space. In addition, the holes 60 in the side of the cover 58, which can be opened or closed, provide ventilation when needed or a totally closed environment when needed. Condensation can also be created by changing the interior temperature by use of the ventilation holes. When the interior of the shelf 10 is warmer than the room in which is place, the opened ventilation holes 60 allow cool air to enter the interior shelf environment, and when the interior of the shelf 10 is cooler than the room in which it is placed, the opened ventilation holes 60 allow warm air to enter the interior shelf environment.

This embodiment also provides an optimal growing environment for Bonsai plants 70 because the primary tray 14 can easily be placed in the window when the sun is shining in the window or warming the window. When the window is allowing a draft on the plant, such as at night or on cold or cloudy days, or if the sun is providing too much heat, the primary tray 14 can easily be removed and placed in a more environmentally friendly place, such as on a flat surface away from the window, in another window, on an a vertically protruding surface other than a window or the like. Additionally, for Bonsai plants 70 that like a cooler environment during the winter months, placement of the plant on the shelf 10 in the window can provide a cooler environment on the shelf 10 than in other places in the room. Preferably, the Bonsai plant 70 is in a container or other accumulation of a growing medium.

While this embodiment shows the use of the shelf 10 as a useful device for growing Bonsai plants 70, the shelf 10 is also useful for growing most other kinds of plants. Naturally, the shelf 10 is a device that can benefit all plants that benefit from sunlit conditions, as the shelf 10 provides a convenient location at windows for placement of the plants thereon. Also combinations of the conditions that provide an optimal growing environment for Bonsai plants 70 can provide optimal growing conditions for a variety of other plants.

In addition, rather than gravel 68, any growing medium, such as soil, humus, peat moss and the like, may be placed on the top side 16 of the primary tray 14. In this manner, plants may be grown directly in the growing medium, without the need for a separate container for the plant. In this embodiment, an upper rim 42 in the range of ¾ to 2½ inches high would be preferred. Drainage holes in the primary tray 14 or along the bottom of the upper rim 42 also could be included.

The shelf 10 is also particularly useful as device for growing plants from seed, as the placement of the shelf 10 in a window can provide optimal sunlight, and use of the cover 58 can provide protection from drafts and increased humidity. Additionally, the primary tray 14 can easily be taken off the window at night or on cold and/or cloudy days, thereby preventing drafts and cool temperatures from harming the plants. As a result, by way of example, use of the shelf 10 as a device to grow plants from seeds, enables the user to start growing plants in late winter and/or early spring, so that by the time the outdoor temperatures are suitable for plants, the plants already are partially grown.

Figure 6A:
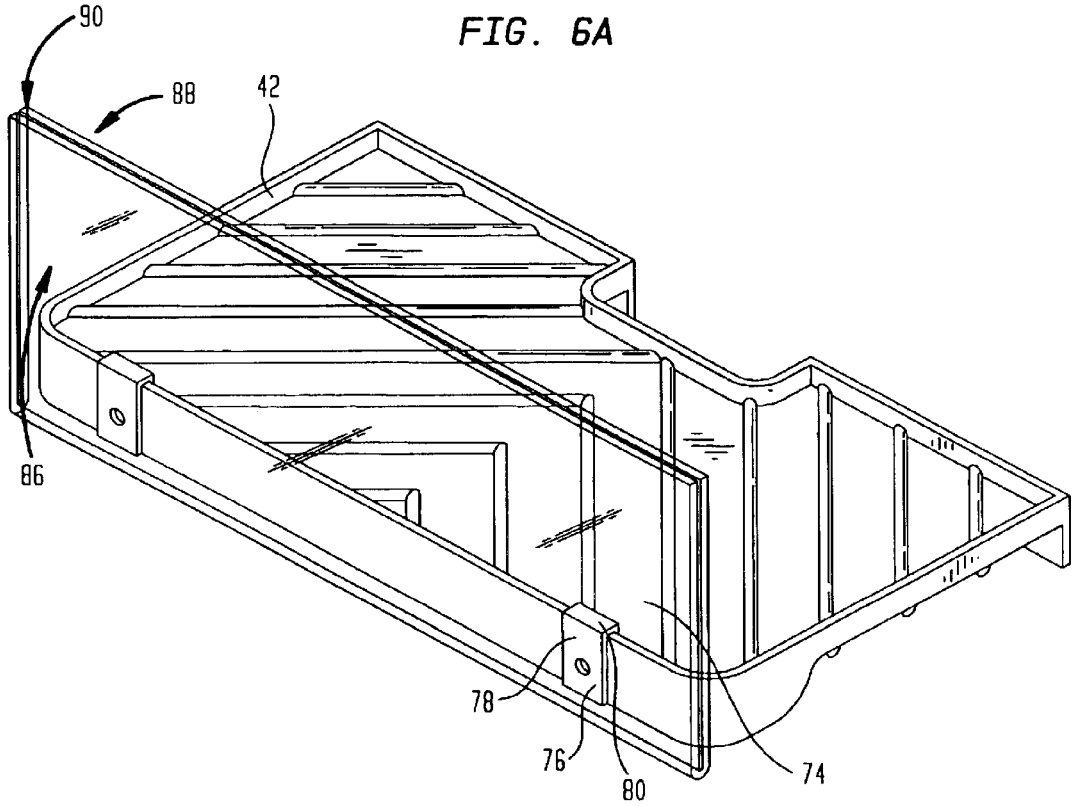
FIG. 6A is a perspective view of the shelf including an accessory.
Figure 6B:
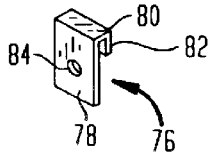
FIG. 6B is a perspective view of the bracket used in the view illustrated in FIG. 6A.

FIGS. 6A and 6B illustrate an embodiment of the invention whereby an accessory 74 is attached to the shelf 10. In this embodiment, the accessory 74 is a picture frame. At least one accessory bracket 76 is used to attach the accessory 74 to the upper rim 42. As seen in this embodiment, the accessory bracket 76 has an accessory flange 78, which is attached to the accessory 74. The accessory bracket 76 also has a hooking means for hooking the accessory 74 to the upper rim 42. In this embodiment, the hooking means has a top flange 80 connected generally at a right angle to the accessory flange 78, and a side flange 82 attached generally at a right angle to the top flange 80. As seen, the top flange 80 and the side flange 82 hook over the top of the upper rim 42.

In this embodiment, two accessory brackets 76 are glued to the picture frame. However, other attachment means could be used. The picture frame could be molded with the bracket 76 already attached. In addition, the accessory flange 78 could have an opening 84, and the accessory 74 could be attached to the accessory bracket 76 by a inserting a setting device such as a screw or a bolt, through the opening 84 and into the accessory 74. Also, the accessory 74 could be attached to the accessory bracket 76 by a loop and hook material, such as the type sold under the trademark VELCRO, by glue, or the like.

The picture frame in this embodiment is made of clear plastic. It has a front side 86 and a back side 88, with a space in-between for insertion of pictures or other thin, flat objects, such as documents or drawings. An opening 90 is provided in the top of the frame, between the front side 86 and back side 88, where items can be inserted. The opening could also be located at the end of the frame. The frame can be divided into sections to hold more than one picture.

In this embodiment, the accessory 74 is attached to the front upper rim 42. However, it is to be understood that accessories can be attach to any of the upper rims 42 in this manner. In addition, while this embodiment shows a picture frame as the accessory 74, it is to be understood that any number of accessories could be added. Some accessories include, but are not limited to, other types of frames, a picket fence, a cork board, a message board, a dry eraser board, and the like.

In addition, hangers (not shown) can be hung over the upper rim 42, so that items can be hung over the sides of the shelf 10. Also, holes or hooks (not shown) could be added to the upper 42 or lower rims 44, and items could be hung thereon.

Figure 7:
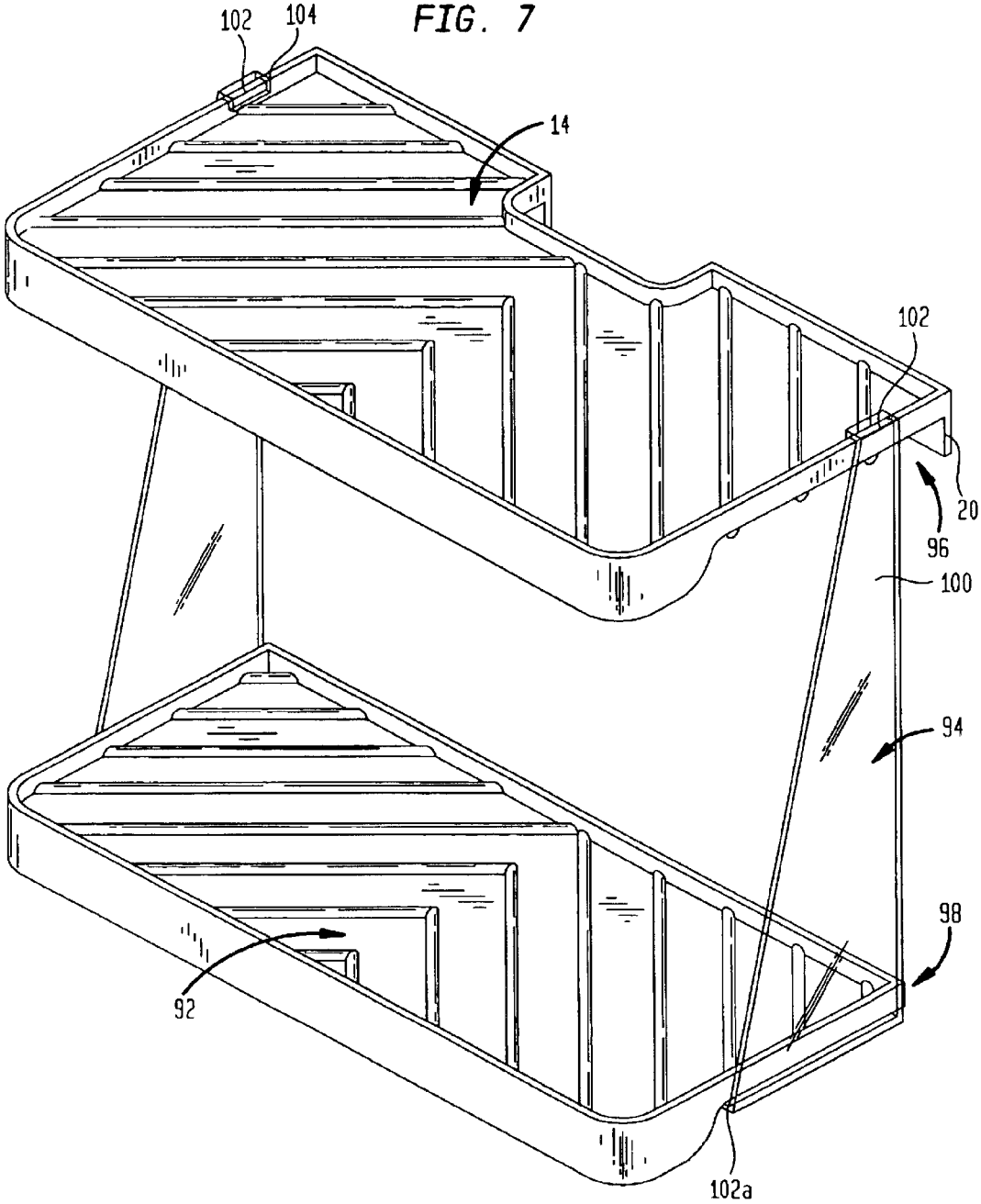
FIG. 7 is a perspective view the shelf having more than one tray.

At least one additional tray can be attached to the shelf 10 of the current invention, as illustrated in FIG. 7. In this embodiment, a second tray 92 is attached to the primary tray 14 by an attachment means. In this embodiment two attachment pieces 94 are used to attach the second tray 92 to the primary tray 14. Each attachment piece 94 has an top end 96 that attaches to the primary tray 14 and a bottom end 98 that attaches to the second tray 92. Each top end 96 and bottom end 98 has a hooking means for hooking the attachment piece 94 respectively to the primary tray 14 and second tray 92.

In this embodiment, each attachment piece 94 has a hooking means at the top end 96 and the bottom end 98 that is similar to the horizontal member bracket 52 illustrated in FIGS. 4A and 4B, Specifically, side piece 100 is attached at the top end 96 generally at a right angle to a top flange 102. The top flange is attached generally at a right angle to a hooking flange 104. The top flange 102 and booking flange 104 together form a hook that is placed over the top of the upper rim 42 on the side of the primary tray 14.

In a similar manner, each attachment piece 94 has a bottom end 98 that attaches to the second tray 92. The bottom end 98 of the side piece 100 is attached generally at a right angle to a bottom flange 102*a*. The bottom flange 102*a* is attached generally at a right angle to a booking flange. The bottom flange 102*a* and the hooking flange at the bottom end 98 of the attachment piece 94 is an inverted version of the top flange 102 and hooking flange 104 of the top end 96 of the attachment piece 94. The bottom flange 102*a* and hooking flange together form a hook that is placed under the bottom of the lower rim 44 on the side of the second tray 92. However, it is to be understood that any kind of hooks could be used. In this embodiment, the lower rim 44 of the second tray 92 does not have a cut away 46 portion or has only a modified cut away 46 portion so that a bottom rim is included on the sides of the second tray 92, onto which the attachment pieces 94 can be attached.

In this embodiment, the side piece 100 is wider at the bottom than at the top. In addition, the side of the side piece 100 that is closest to the window is generally parallel to the window. The side of the side piece 100 that is farthest from the window is diagonal. The side piece 100 is positioned on the primary tray 14 at a location that is closer to the window edge than to the front edge of the primary tray 14. In this manner, a majority of the support for the second tray 92 is placed on the portion of the upper rim 42 of the primary tray 14 that is closest to the window. As a result, a cantilever effect is not created, and the weight of the second tray 92 is primarily supported by the projecting member 20 and the horizontal member 22 of the primary tray.

However, it is to be understood that to the extent that the weight of the second tray 92 and/or its contents is light in comparison with the weight of the primary tray 14, the side pieces 100 can be rectangular and can be placed along the side upper rims 42 of the primary tray 14 and side lower rims 44 of the second tray 92 in locations other than those closest to the window.

In this embodiment, the side piece 100 preferably is made of clear plastic to enable to sunlight to shine through. In addition, plastic is lighter in weight than other materials that could be used. Ultimately, however, the side pieces 100 could be made of a variety of materials, including but not limited to wood, metal, aluminum, stainless steel, fabric, opaque plastic and the like.

In this embodiment, the second tray 92 is similar to the primary tray 14; however, the second tray 92 lacks the horizontal member 22, set device receptacles 30, cut away 46 portions of the side lower rims 44, and window lock indentations 40 of the preferred embodiment of the primary tray 14. Optionally, in addition, the reinforcers 48, projecting member 20, front lower rim 44, and upper rims 42 could be omitted. It is to be understood, however, that the second tray 92 optionally, also could be identical to the primary tray 14, provided that the lower rim 44 of the second tray 92 does not have a cut away 46 portion or has only a modified cut away 46 portion so that a bottom rim is included on the sides of the second tray 92, onto which the attachment pieces 94 can be attached.

Reference is now made to FIGS. 8A, 8B, 8C and 8D, wherein another embodiment of the invention is illustrated. In this embodiment, the projecting member 20 is separate from the primary tray 14. As will be described, the projecting member 20 is attached to the primary tray 14 to enable to shelf 10 to be hung from the window structure 12.

Figure 8A:
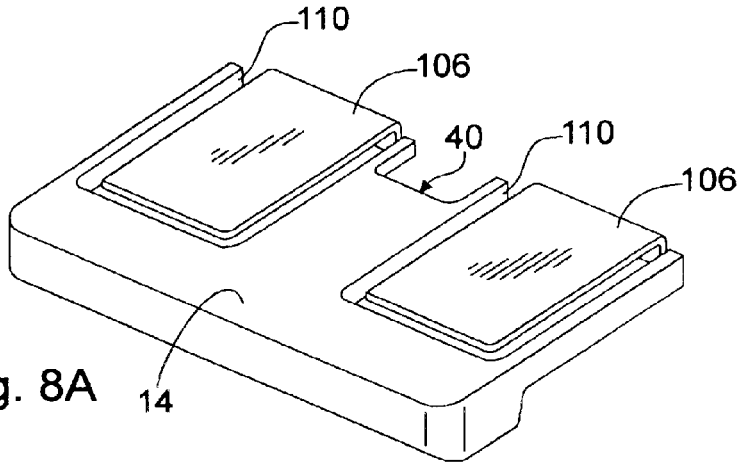
FIG. 8A is a cut away perspective view of another embodiment of the shelf.
Figure 8B:
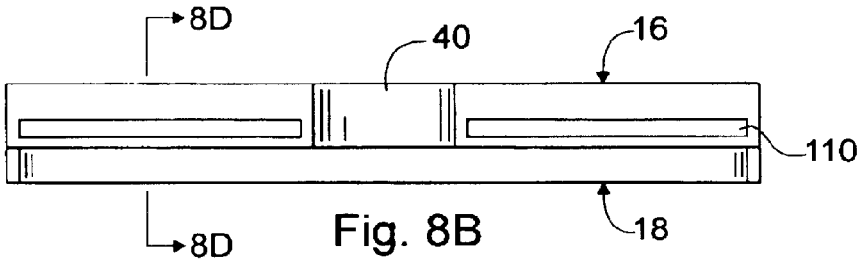
FIG. 8B is a front perspective view of the primary tray illustrated in FIG. 8A.
Figure 8C:
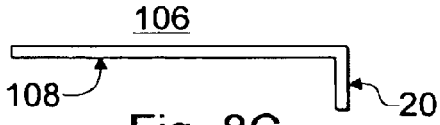
FIG. 8C is a side perspective view of the projecting member insert illustrated in FIG. 8A.
Figure 8D:
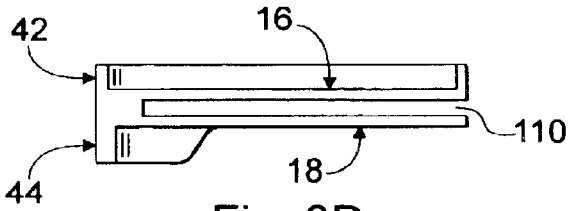
FIG. 8D is a is a cross-sectional side view of the primary tray illustrated in FIG. 8A.

FIG. 8A is a cut away perspective view of this embodiment of the shelf 10. FIG. 8B is a front perspective view and FIG. 8D is a is a cross-sectional side view of the primary tray 14 illustrated in FIG. 8A. FIG. 8C is a side perspective view of the projecting member insert 106 illustrated in FIG. 8A.

As seen in this embodiment, at least one projecting member 20 is attached generally at right angles to a tray flange 108 to create a projecting member insert 106. In this embodiment, two projecting member inserts 106 are included. The primary tray 14 has at least one insert cutout 110. The at least one projecting member 20 is attached to the primary tray 14 by inserting the tray flange 108 of the at least one projecting member insert 106 into the at least one insert cutout 110. As illustrated in FIGS. 8A and 8*b*, two insert cutouts 110 are included; one on each side of the window lock indentation 40. One projecting member insert 106 is inserted in each insert cutout 110. It is to be understood, however, that if the primary shelf 10 does not have a window lock insert, one insert cutout 110 could be used, and one projecting member insert 106 inserted therein. If only one insert cutout 110 and one projecting member insert 106 are used, preferably, the insert cutout 110 and the projecting member insert 106 would be centered in the primary tray 14 and would be almost the width of the primary tray 14.

The embodiments of the shelf 10 in the current invention can serve a vast array of functions. In addition to the uses already described, the shelf 10 can have other uses, which include but are not limited to the uses that follow. It can hold items such as televisions, radios, candles, including aromatherapy candles, religious icons, decorative pieces, including seasonal decorations, and the like. In addition, the shelf 10 can be used to provide a variety of pets a place to bask in the sun, in that the shelf 10 can hold, or be turned into, a bird cage, a small mammal cage, including hamsters, mice and the like, a fish tank, and/or a reptile tank. Further, the window shelf 10 could hold and display fountains and rock gardens. The window shelf 10 of the current invention can also be used as a serving tray, such as for cocktails, tea, food and the like, particularly for serving areas that are near a window. Also, wet items such as sweaters, dish towels, lingerie and the like can be hung on hangers, and the hangers can be hung from the upper rim 42; thereby creating an area near a window for drying the wet item. It is to be understood that these additional uses are exemplary and not intended to be exhaustive.

The shelf 10 of the current invention can also be hung on any vertically projecting surface behind which the projecting member 20 can be placed and in front of which the engaging edge 24 of the horizontal member 22 can be placed. Examples of such surfaces include, but are not limited to, the headboard of a bed, a railing, the back of a chair, and the like. As a result, the shelf 10 of the present invention presents a variety of manners by which the contents of the shelf 10 can be displayed. The shelf 10 can be hung in the window at desirable times. At other times, the shelf 10 can be hung on other vertically projecting surfaces, or placed on a flat surface. Consequently, the shelf 10 of the present invention is highly versatile. In addition to the benefits already described, the shelf 10 can be effectively used for a variety of purposes, which include, but are not limited to, as a space saver, as means by which to increase outside exposure, such as by apartment dwellers with limited window and other outside exposure, as a convenient way to place plants, pets and the like near the window at beneficial times and to follow the sun from window to window throughout the day.

While preferred dimensions of the various portions of the preferred embodiments of the shelf 10 have been provided, it is to be understood that these dimensions, while preferred in the preferred embodiments, are discretionary, as the shelf 10 can be made of varying sizes to adapt to various windows, shelf materials, uses and the like.

Although the invention has been illustrated by reference to specific embodiments, it will be apparent, to those of ordinary skill in the art that various changes and modifications may be made which clearly fall within the scope of the invention. The invention is intended to be protected broadly within the spirit and scope of the appended claims.

Once the projecting member insert 106 is inserted in the insert cutout 110, the shelf 10 functions in the manners described in relation to the previously described FIGS. 1–3 and 5–8. In this embodiment, the primary tray 14 can be made of a material that would make an attractive and/or functional shelf 10, but that would not function well as the projecting member 20. By way of example, the primary tray 14 could be made of a type of wood that might not be able to function as the projecting member 20 because it was too thick to be inserted behind the top of the window structure 12. In this example, the projecting member insert 106 could be made of a metal that could function as a projecting member 20. In this embodiment, two materials can be combined to create a functioning window shelf 10. It is to be understood that the primary tray 14 could be made of a variety of materials, including but not limited to wood, plastic, metal, aluminum, stainless steel, straw, and the like. The projecting member insert 106 could be made materials, including but not limited to, wood, plastic, metal, aluminum, stainless steel, and the like.

What is claimed is:

1. A shelf that can be hung on a window structure, said shelf comprising:

a primary tray, said primary tray further having a top side and a bottom side and at least one insert cutout, said at least one insert cutout located between said top side and said bottom side;

at least one projecting member insert, said insert comprising at least one projecting member and at least one tray flange, said at least one tray flange being insertable into said at least one insert cutout, and said at least one projecting member being insertable behind the back of the window structure.

2. The shelf of claim 1, said shelf further comprising:

a horizontal member, said horizontal member located on the bottom side of said primary tray, wherein said horizontal member is engagable with the front of the window structure.

3. A shelf that can be hung on a window structure, said shelf comprising:

a primary tray, said primary tray having a projecting member, said projecting member being insertable behind the back of a window structure, said primary tray further having a top side and a bottom side;

a horizontal member, said horizontal member located on the bottom side of said primary tray, wherein said horizontal member is engagable with the front of the window structure;

a bottom rim, said bottom rim projecting downward from the edges of said primary tray, said bottom rim on the sides of the tray having a height that is equal to or greater than the height of the projecting member and the height of the bottom rim of the front edge of the primary tray whereby when the primary tray is taken off the window structure and is placed on a horizontal surface, the primary tray is flat.

4. The shelf as described in claim 3, wherein said horizontal member is moveable.

5. The shelf as described in claim 4, wherein said horizontal member further comprises a perpendicular piece, said perpendicular piece further comprising at least one opening, said shelf further comprising at least one set device, said at least one set device projecting through said at least one opening in said perpendicular piece and engaging said bottom said of said primary tray, said set device affixing said horizontal piece to said primary tray and affixing said horizontal piece against said window structure.

6. The shelf as described in claim 3, wherein said top side of said primary tray has an upper rim.

7. The shelf as described in claim 6, wherein said horizontal piece further comprises a plurality of brackets said brackets engaging said upper rim on opposite sides of said primary tray, each of said brackets further comprising at least one set device, said at least one set device engaging said rim, said at least one set device affixing the lateral movement of said horizontal member against said window structure.

8. The shelf as described in claim 3, said shelf further comprising a cover.

9. The shelf as described in claim 8, said cover further comprising at least one ventilation hole.

10. The shelf as described in claim 3, wherein said primary tray holds at least one plant.

11. The shelf as described in claim 3, wherein said shelf further comprises a growing medium, said growing medium being placed on the top side of said primary tray.

12. The shelf as described in claim 3, wherein said shelf further comprises an accessory.

13. The shelf as described in claim 3, said shelf further comprising a second tray, said second tray attached to said primary tray by an attachment means.

14. The shelf as described in claim 3, wherein said primary tray has at least one window lock indentation.

15. The shelf as described in claim 3, wherein said primary tray further comprises at least one reinforcer.

16. A shelf that can be hung on a window structure, said shelf comprising:

a primary tray, said primary tray having a projecting member, said projecting member insertable behind the back of a window structure, said primary tray further having a top side and a bottom side;

a horizontal member, said horizontal member located on the bottom side of said primary tray, wherein said horizontal member is engagable with the front of the window structure, said shelf further comprising a bottom rim, said bottom rim projecting downward from the edges of said primary tray, said bottom rim having a height that is no greater than the height of the projecting member, the height of the bottom rim of the front edge of the primary tray being equal to the height of the projecting member, whereby when the primary tray is taken off the window structure and is placed on a horizontal surface, the primary tray is flat.

17. The shelf as described in claim 16, wherein said horizontal member is moveable.

18. The shelf as described in claim 17, wherein said horizontal member further comprises a perpendicular piece, said perpendicular piece further comprising at least one opening, said shelf further comprising at least one set device, said at least one set device projecting through said at least one opening in said perpendicular piece and engaging said bottom said of said primary tray, said set device affixing said horizontal piece to said primary tray and affixing said horizontal piece against said window structure.

19. The shelf as described in claim 16, wherein said top side of said primary tray has an upper rim.

20. The shelf as described in claim 19, wherein said horizontal piece further comprises a plurality of brackets said brackets engaging said upper rim on opposite sides of said primary tray, each of said brackets further comprising at least one set device, said at least one set device engaging said rim, said at least one set device affixing the lateral movement of said horizontal member against said window structure.

21. The shelf as described in claim 16, said shelf further comprising a cover.

22. The shelf as described in claim 21, said cover further comprising at least one ventilation hole.

23. The shelf as described in claim 16, wherein said primary tray holds at least one plant.

24. The shelf as described in claim 16, wherein said shelf further comprises a growing medium, said growing medium being placed on the top side of said primary tray.

25. The shelf as described in claim 16, wherein said shelf further comprises an accessory.

26. The shelf as described in claim 16, said shelf further comprising a second tray, said second tray attached to said primary tray by an attachment means.

27. The shelf as described in claim 16, wherein said primary tray has at least one window lock indentation.

28. The shelf as described in claim 16, wherein said primary tray further comprises at least one reinforcer.

29. A shelf that can be hung on a window structure, said shelf comprising:

a primary tray, said primary tray having a top side and a bottom side, said primary tray being generally perpendicular in relation to the window when said shelf is attached to the window structure, said primary tray having a window edge, said window edge being the edge that is closest to the window when the shelf is attached to the window structure, said window edge having a projecting member, said projecting member being insertable behind the back of a window structure, said primary tray further having at least one window lock indentation, said at least one window lock indentation being a section of said primary tray that is completely cut out through said top side and said bottom side so that a space is created in said primary tray from said window edge inward in said primary tray, said projecting member not being present at said at least one window lock indentation.

30. The shelf as described in claim 29, said primary tray further comprising a horizontal member, said horizontal member being located on the bottom side of said primary tray, wherein said horizontal member is engagable with the front of the window structure.

31. The shelf as described in claim 30, wherein said horizontal member is moveable.

32. The shelf as described in claim 31, wherein said horizontal member further comprises a perpendicular piece, said perpendicular piece further comprising at least one opening, said shelf further comprising at least one set device, said at least one set device projecting through said at least one opening in said perpendicular piece and engaging said bottom said of said primary tray, said set device affixing said horizontal piece to said primary tray and affixing said horizontal piece against said window structure.

33. The shelf as described in claim 31, wherein said top side of said primary tray has an upper rim and said horizontal piece further comprises a plurality of brackets, said brackets engaging said upper rim on opposite sides of said primary tray, each of said brackets further comprising at least one set device, said at least one set device engaging said rim, said at least one set device affixing the lateral movement of said horizontal member against said window structure.

34. The shelf as described in claim 29, said shelf further comprising a cover.

35. The shelf as described in claim 34, said cover further comprising at least one ventilation hole.

36. The shelf as described in claim 29, wherein said top side of said primary tray has an upper rim.

37. The shelf as described in claim 29, wherein said primary tray holds at least one plant.

38. The shelf as described in claim 29, wherein said shelf further comprises a growing medium, said growing medium being placed on the top side of said primary tray.

39. The shelf as described in claim 29, wherein said shelf further comprises an accessory.

40. The shelf as described in claim 29, said shelf further comprising a second tray, said second tray attached to said primary tray by an attachment means.

41. The shelf as described in claim 29, wherein said primary tray further comprises at least one reinforcer.

* * * * *